US005921747A

United States Patent [19]

Mürbe

[11] Patent Number: 5,921,747

[45] Date of Patent: Jul. 13, 1999

[54] STEAM TURBINE COMPONENT WITH THROTTLE ELEMENT FOR REGULATING STEAM FLOW AND STEAM TURBINE HAVING THE STEAM TURBINE COMPONENT

[75] Inventor: Dieter Mürbe, Dresden, Germany

[73] Assignee: Siemens Aktiengesellschaft, Munich, Germany

[21] Appl. No.: 08/996,368

[22] Filed: Dec. 22, 1997

Related U.S. Application Data

[63] Continuation of application No. PCT/DE96/01011, Jun. 10, 1996.

[30] Foreign Application Priority Data

Jun. 20, 1995 [DE] Germany ..... 195 22 359

[51] Int. Cl.[6] ..... F01D 17/14

[52] U.S. Cl. ..... 415/148; 415/157; 251/251

[58] Field of Search ..... 415/157, 167, 415/156, 150, 148, 159, 158; 251/251, 324, 343, 347

[56] References Cited

U.S. PATENT DOCUMENTS 2,847,186 8/1958 Anderson et al. .

FOREIGN PATENT DOCUMENTS 1 426 792 3/1969 Germany .
95/12-57 5/1995 WIPO .

OTHER PUBLICATIONS

"Switching Valve as a Control Device for Extraction–Steam Turbines" (Speicher), Maschinenbautechnik 15, vol. 4, 1966.

*Primary Examiner*—Christopher Verdier
*Assistant Examiner*—Matthew T. Shanley
*Attorney, Agent, or Firm*—Herbert L. Lerner; Laurence A. Greenberg

[57] ABSTRACT

A steam turbine component and a steam turbine include a main axis and a separating element which is disposed in and fills a cross-sectional area at right angles to the main axis and which has at least one flow passage through which steam flows. A throttle element which can be displaced substantially along the main axis is provided for regulating steam flow through the flow passage. The throttle element has a first sealing surface and a second sealing surface. The sealing surfaces are in sealing contact with the separating element in a position closing the flow passage, and the sealing surfaces are at a distance from the separating element in a position at least partially opening the flow passage. The sealing surfaces are respectively located in a cross-sectional plane extending at right angles to the main axis, so that at most small frictional forces have to be overcome during opening of the flow passage and, in addition, a high degree of sealing is achieved.

9 Claims, 2 Drawing Sheets

STEAM TURBINE COMPONENT WITH THROTTLE ELEMENT FOR REGULATING STEAM FLOW AND STEAM TURBINE HAVING THE STEAM TURBINE COMPONENT

CROSS-REFERENCE TO RELATED APPLICATION

This application is a continuation of International Application Ser. No. PCT/DE96/01011, filed Jun. 10, 1996, which designated the United States, the priority of which is claimed under 35 U.S.C. 120, which PCT application is base upon German application Serial #: 19522359.41filed Jun. 20, 1995, the international priority of which is claimed under 35 U.S.C. 119.

BACKGROUND OF THE INVENTION

Field of the Invention

The invention relates to a steam turbine component and a steam turbine with a throttle element which can be displaced essentially along a main axis, in particular the main axis of the turbine, for regulating steam flow through a flow passage provided in a separating element that is disposed in and fills a cross-sectional area extending at right angles to the main axis.

Various control elements are known for regulating the steam flow in a steam turbine. A comparison of control elements based on valves and on rotary valves is described in an article entitled "Der Drehschieber als Regelorgan für Entnahme-Dampfturbinen [The Rotary Valve as a Control Element for Extraction Steam Turbines] by K. Speicher and E. Mietsch, in the publication Maschinenbautechnik, Berlin, Volume 15, No. 4, 1966, pages 185 to 190. A further control element is known from German Published, Non-Prosecuted Patent Application DE 1 426 792.

Axial and radial flow valves are mentioned as possible forms of rotary valves. The valves are used to completely or partially shut off openings which are provided in a nozzle cover extending over the cross-section of the steam turbine. A first form of a valve includes a ring, which can be rotated in the circumferential direction, which has openings analogous to the openings in the nozzle cover and though which a flow occurs axially. The flow through the openings of the valve takes place in the axial direction, i.e. in the direction of the main axis of the steam turbine. In a second form, a rotatable ring is again provided but the flow through that ring takes place in the radial direction, for which purpose the openings in the nozzle cover cause a deflection of the flow from the radial to the axial direction. The valve is then in contact over a large area with a corresponding deflection part of the nozzle cover. Motion of the valve must therefore take place against a substantial frictional resistance. In a third configuration, radially displaceable annular segments are provided for closing the openings in the nozzle cover. A radial flow valve with an axially displaceable ring is described as a fourth configuration, with the nozzle cover in that case again having a flow-deflecting projecting structure on which the axially displaceable ring is guided. The problem of large frictional forces which have to be overcome also arises in that case. Although complete static balancing is possible during throttle control in the radial rotary valves mentioned above, a relatively large radial gap must be provided in order to ensure free thermal expansion. Due to that fact, it is not possible to close the nozzle cover opening completely and leakage losses due to an undesirable flow of steam must be accepted.

When the known axial rotary valves are employed, large contact and frictional forces occur which lead to corresponding wear of the parts that slide on one another. In addition, large actuation drives are to be provided for the operation of such axial rotary valves. Complicated and expensive structures with balancing surfaces are known for reducing the contact forces. However, they involve a corresponding space requirement in the radial direction. Those structures are therefore unusable in practice in the case of turbines of the reaction type. As a result of the known disadvantages, rotary valves are currently used at relatively low extraction steam pressures, if at all.

SUMMARY OF THE INVENTION

It is accordingly an object of the invention to provide a steam turbine component with a throttle element for regulating steam flow and a steam turbine having the steam turbine component, which overcome the hereinafore-mentioned disadvantages of the heretofore-known devices of this general type, which have a throttle element for regulating steam flow and in which the throttle element is suitable for use in a turbine for high extraction steam pressures.

With the foregoing and other objects in view there is provided, in accordance with the invention, a steam turbine component, comprising a main axis; a cross-sectional area; a separating element disposed in and filling the cross-sectional area perpendicular to the main axis; a wall extending substantially parallel to and at a distance from the cross-sectional area; at least one flow passage passing through the separating element, extending away from the cross-sectional area along the main axis and limited by the wall, for conducting a steam flow; and a throttle element to be displaced substantially along the main axis for regulating the steam flow through the flow passage, the throttle element having first and second sealing surfaces, the first sealing surface sealingly contacting the wall and the second sealing surface contacting the separating element in the cross-sectional area or plane, in a throttle element position closing the flow passage, and the sealing surfaces disposed at a distance from the separating element in a throttle element position at least partially opening the flow passage.

The disadvantages of known rotary valves are avoided through the use of a throttle element which is axially displaceable and is in contact with the separating element in a position closing the flow passage of the separating element (this is, in particular, an annular opening with intermediate webs in a nozzle cover) and is at a distance from the separating element in each other position which partially or completely opens the flow passage. Wear due to frictional contact with the separating element is, in particular, avoided and the flow passage is completely shut off or, in the case of a plurality of flow passages, complete closure of the latter is achieved, so that undesirable steam flow losses are avoided. Large actuating drives are likewise unnecessary because frictional contact with the separating element is avoided. When the steam turbine component is used in a steam turbine, in particular in the low-pressure part of the steam turbine, the main axis of the steam turbine component coincides with the main axis of the steam turbine.

A deflection of the flow from a radial direction into an axial direction takes place in the flow passage as a result of the flow passage extending from the cross-sectional area in the axial direction and having a wall extending parallel to the cross-sectional area. The flow passage is shut off by the throttle element at the end of the flow passage in which the flow takes place radially. When the flow passage is closed, a definite force closure can be achieved, for example, by the throttle element being forced into the position closing the flow passage by a small residual steam force.

An appropriately matched configuration of the sealing surfaces appears in each case by configuring the flow passage so that a flow is formed in the axial direction or so that a deflection into the radial direction is caused. In the case of a flow passage with purely axial flow, both sealing surfaces are preferably in direct contact with the separating element in the cross-sectional plane. In the case of a flow passage which also causes a radial flow of the steam, the first sealing surface is preferably in contact with the wall referred to above and the second sealing surface is in direct contact with the separating element in the cross-sectional area.

In accordance with another feature of the invention, the sealing surfaces are constructed as thin-walled circular rings. In this way, the sealing surface is almost linear, so that there is, essentially, no frictional contact with the separating element but a high degree of sealing is, nevertheless, achieved.

In accordance with a further feature of the invention, the throttle element is a circular double seating ring which is disposed centrally relative to the main axis. The central configuration causes the center of the circular ring to coincide with the main axis when viewed in cross-section. In this way, simple manufacture of the guides of a rotary ring displacing the double seating ring and of the guides of the separating element is achieved in a turbine casing.

In accordance with an added feature of the invention, with respect to simple assembly, the double seating ring is made up of two semicircular segments. However, it is also conceivable for the double seating ring to be made up of a plurality of circular segments. The double seating ring preferably has an axial extent which corresponds to the axial extent of the flow passage and radially extending webs on which the sealing surfaces are disposed. This substantially avoids leaks which depend on the steam temperature.

In accordance with an additional feature of the invention, at least two, in particular three, guide grooves extend parallel to the main axis for exact guidance of the throttle element. Preferably two guide pins, which are fastened to the turbine casing, engage in each of the guide grooves. Exact central alignment of the throttle element can be achieved through the use of these guide pins which engage in the guide grooves and a substantially clearance-free guidance of the throttle element is provided during axial motion.

In accordance with yet another feature of the invention, the guide pins are eccentric pins. An eccentric pin has, for example, two complete cylinders of circular cross-section which respectively extend along an axis and are permanently connected to one another at adjacent end surfaces. The directions of the axes are then identical, although with one full cylinder being offset relative to the other, i.e. being disposed eccentrically. In this way, exact guidance of the throttle element in the turbine casing is achieved, so that, for example, compensation can also be provided for manufacturing tolerances.

In accordance with yet a further feature of the invention, the throttle element has at least one displacement groove, in particular three displacement grooves, which extends both in the axial direction and in the circumferential direction, i.e. extends obliquely relative to the main axis.

In accordance with yet an added feature of the invention, there is provided a rotary ring which can be rotated in the circumferential direction and engages in this displacement groove, in particular through the use of a control pin. As a result of the displacement groove being aligned obliquely relative to the main axis, a conversion of the rotary motion of the rotary ring into an axial motion of the throttle element takes place during a rotation of the rotary ring in the circumferential direction. In this way, a displacement of the throttle element in the axial direction is brought about in a simple manner and with the use of only small forces.

With the objects of the invention in view, there is also provided a steam turbine, in particular a steam turbine with a high extraction steam pressure, comprising a steam turbine component with a throttle element.

Other features which are considered as characteristic for the invention are set forth in the appended claims.

Although the invention is illustrated and described herein as embodied in a steam turbine component with a throttle element for regulating steam flow and a steam turbine having the steam turbine component, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
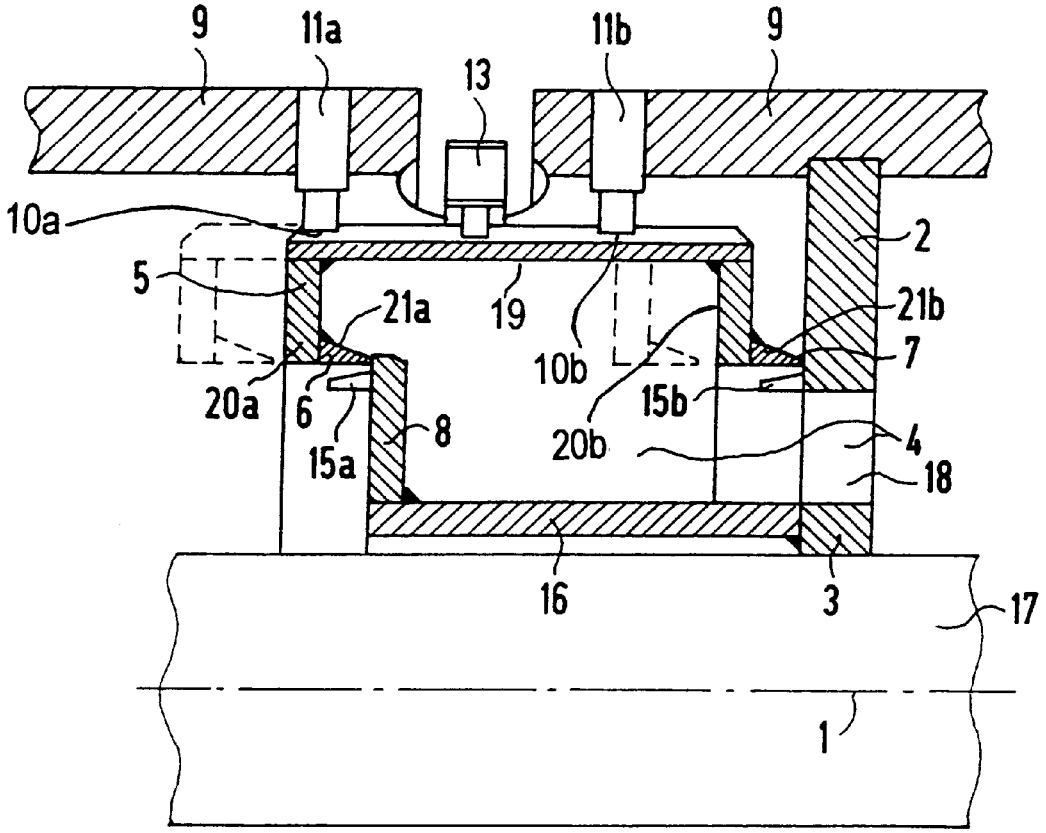
FIG. 1 is a fragmentary, diagrammatic, longitudinal-sectional view of a steam turbine with a throttle element.

Referring now to the figures of the drawings in detail and first, particularly, to FIG. 1 thereof, there is seen a longitudinal section of a portion of a steam turbine at the beginning of a low-pressure part before a low-pressure blading region. The steam turbine, which is rotationally symmetrical about a main axis 1, has a turbine casing 9 that encloses the turbine rotor 17. A cross-sectional area 2 of the steam turbine between the turbine rotor 17 and the turbine casing 9 is filled by a separating element or feature 3, which is a so-called window ring. The separating element 3 has a flow passage 4 which is formed by an annular opening 18 with intermediate webs in the separating element 3, a sleeve 16 extending in the direction of the main axis 1 and an annular wall 8. The sleeve 16 is fastened to the separating element 3 in the immediate vicinity of the opening 18 on a side facing towards the turbine rotor 17. The annular wall 8 is tightly connected to the sleeve 16 and is located on a side of the sleeve 16 facing away from the turbine rotor 17. The wall 8 therefore stands on the sleeve 16 in the form of an annular collar, so that a surface is formed extending parallel to and at a distance from the separating element 3. An axially displaceable throttle element 5 is disposed between the flow passage 4 and the turbine casing 9.

Guide pins 11*a*, 11*b* respectively extend in a plane at right angles to the main axis 1 and are fastened in the turbine casing 9. At least three respective pairs of the guide pins 11*a*,

11*b* are fastened on the periphery of the turbine casing 9. The guide pins 11*a*, 11*b* which are represented are offset relative to one another, so that they respectively engage in a corresponding groove 10*a*, 10*b* of the throttle element 5. The throttle element 5 has a throttle sleeve 19 extending along the main axis 1 and two annular webs 20*a*, 20*b* which are disposed at a distance from one another, are fastened to the throttle sleeve 19 on a side facing towards the turbine rotor 17 and extend from the throttle sleeve 19 towards the main axis 1. The throttle element 5 can be displaced in the direction of the main axis 1, i.e. in the axial direction, through the use of a rotary ring 13 extending at the periphery of the turbine casing 9. Throttle noses 21*a*, 21*b* respectively extend towards the separating element 3 in the axial direction and act on the webs 20*a*, 20*b*. The throttle nose 21*a* forms a first annular sealing surface 6 and the throttle nose 21*b* forms a second annular sealing surface 7. The first sealing surface 6 is in contact with the wall 8 and the second sealing surface 7 is in direct contact with the separating element 3 in a region between the turbine casing 9 and the opening 18. Tight closure of the flow path 4 is achieved in this way. Sleeve-type throttle collars 15*a*, 15*b* are respectively fastened to the wall 8 and to the separating element 3 and are respectively directed in the axial direction away from the cross-sectional area 2. The throttle noses 21*a*, 21*b* of the throttle element 5 and the throttle collars 15*a*, 15*b* associated with the flow passage 4 are therefore located directly one above the other. The relationship between the steam throughput and the stroke executed by the throttle element 5 along the main axis 1 can be specified in this way. In particular, it is possible to achieve a linearization of the relationship between the steam throughput and the stroke of the throttle element.

The throttle element 5 is additionally represented in a position shown by a dotted line in FIG. 1 in which the first sealing surface 6 and the second sealing surface 7 are respectively disposed at a distance from the wall 8 and the separating element 3, so that the flow passage 4 is at least partially freed for a flow of steam. A displacement of the throttle element 5 in the axial direction takes place through the use of the rotary ring 13, so that the throughput of steam through the separating element 3 can be regulated from a complete closure of the flow passage 4 to a complete opening of the flow passage 4. Both a central suspension of the throttle element 5, i.e. symmetrical about the main axis 1, and a free thermal expansion, are ensured by suspending the throttle element 5 through the use of the guide pins 11*a*, 11*b* which are guided in the grooves 10*a*, 10*b*. The size of the first sealing surface 6 and of the second sealing surface 7 and the height of the webs 20*a*, 20*b*, i.e. the radial extent of the throttle element 5, can be freely selected to a large extent, so that even complete balancing of the steam forces is possible. The separating element 3 with the flow passage 4, the rotary ring 13 and the throttle element 5 are respectively made up of mutually matching semicircular segments in order to simplify assembly.

Figure 2:
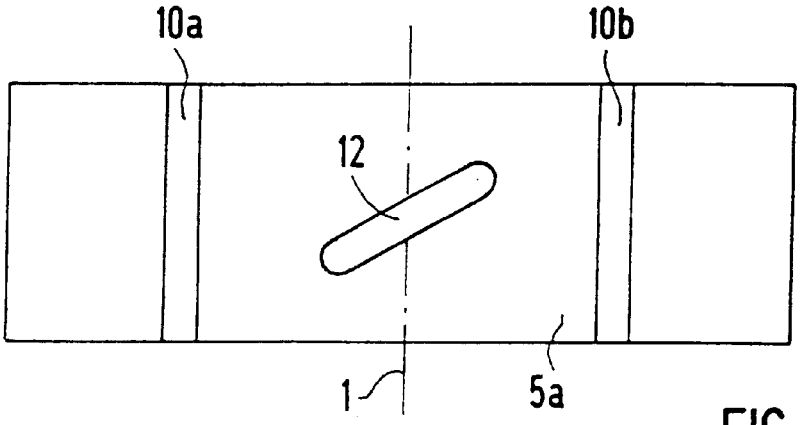
FIG. 2 is a plan view of the throttle element according to FIG. 1.
Figure 3:
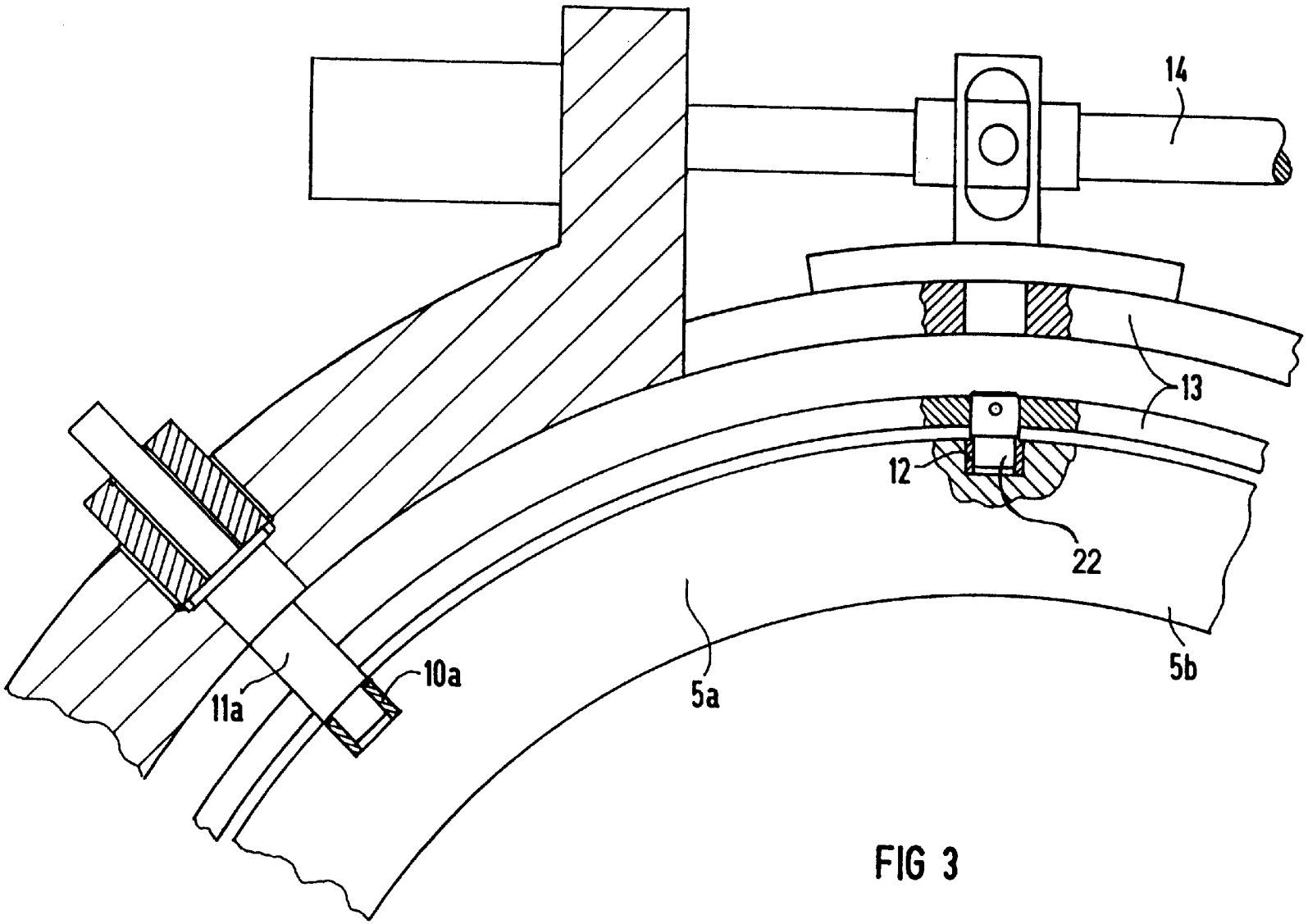
FIG. 3 is a fragmentary, partly broken-away, cross-sectional view of the steam turbine according to FIG. 1.

FIG. 2 shows a plan view of a throttle element 5 as described in FIG. 1 and configured as a double seating ring 5*a*. The double seating ring 5*a* has three pairs of guide grooves 10*a*, 10*b* which are respectively directed along the main axis 1, i.e. in the axial direction. The pairs of guide grooves 10*a*, 10*b* are symmetrically distributed over the circumference of the double seating ring 5*a*, with only one pair being represented for reasons of clarity. A displacement groove 12, which extends obliquely relative to the main axis 1, is provided between the guide grooves 10*a*, 10*b*. A total of three displacement grooves 12 are provided over the circumference. The guide grooves 10*a*, 10*b* are used for suspending the throttle element 5*a* through the use of the respectively corresponding guide pins 11*a*, 11*b*, which engage in the guide grooves 10*a*, 10*b* and are fastened in the turbine casing 9. The guide pins 11*a*, 11*b* are configured as eccentric pins, as is represented in FIG. 3, so that exact alignment of the double seating ring 5*a* relative to the main axis 1 is achieved in this way. The rotary ring 13 extending at the circumference of the turbine casing 9 engages in the displacement grooves 12, so that a displacement of the throttle element 5 in the axial direction is achieved by a rotation of the rotary ring 13.

FIG. 3 shows a portion of the steam turbine according to FIG. 1 in a cross-section in which a guide pin 11*a* configured as an eccentric pin, the rotary ring 13, the throttle element 5 (the double seating ring including two semicircular segments 5*a*, 5*b*) and a drive 14 for the rotary ring 13 are shown.

The rotary ring 13 has control pins 22 which extend in the radial direction and engage in respective displacement grooves 12 of the throttle element 5. Three pairs of guide pins 11*a*, 11*b* and a corresponding number of guide grooves 10*a*, 10*b* and displacement grooves 12 are preferably provided in the circumferential direction.

The invention is characterized by a throttle element which can be displaced in the axial direction and which has two sealing surfaces that respectively end on two boundary walls of a flow passage and seal the flow passage, wherein the boundary walls extend at a distance from one another in the cross-sectional direction of a steam turbine. The sealing surfaces are constructed in such a way that practically no frictional forces have to be overcome during a motion of the throttle element which opens the flow passage. The throttle element is thermally movable through the use of a plurality of guide pins and is suspended centrally relative to the main axis of the steam turbine. A displacement of the throttle element in the direction of the main axis can be achieved through the use of displacement grooves extending obliquely relative to the main axis at the circumference of the throttle element. This displacement takes place through the use of a rotary ring which can be rotated in the circumferential direction and has at least one, and preferably three, control pin which engages in a corresponding displacement groove. The throttle element is preferably suitable for an arbitrarily adjustable throttling of steam flows through openings disposed annularly and centrally relative to the turbine axis before the low-pressure part of steam turbines. It is particularly suitable in the case of reaction turbines and for high extraction steam pressures.

I claim:

1. A steam turbine component, comprising:

a main axis;

a cross-sectional area;

a separating element disposed in and filling said cross-sectional area perpendicular to said main axis;

a wall extending substantially parallel to and at a distance from said cross-sectional area;

at least one flow passage passing through said separating element, extending from said cross-sectional area along said main axis and limited by said wall, for conducting a steam flow; and a throttle element displaceable substantially along said main axis for regulating the steam flow through said flow passage, said throttle element having first and second sealing surfaces, said first sealing surface sealingly contacting said wall and said second sealing surface directly contacting said separating element in said cross-sectional area, in a position closing said flow passage, and said sealing surfaces disposed at a distance from said separating element in a position at least partially opening said flow passage.

2. The steam turbine component according to claim 1, wherein said throttle element is a circular double seating ring disposed centrally relative to said main axis.

3. The steam turbine component according to claim 2, wherein said double seating ring includes two semicircular segments.

4. The steam turbine component according to claim 1, wherein said throttle element has at least two guide grooves extending parallel to the main axis, each of said guide grooves receiving at least one guide pin fastened to a turbine casing.

5. The steam turbine component according to claim 4, wherein the guide pins are eccentric pins.

6. The steam turbine component according to claim 1, wherein said throttle element has at least one displacement groove extending in both a circumferential direction and the direction of said main axis.

7. The steam turbine component according to claim 6, including a rotary ring rotatable in the circumferential direction, engaging in said displacement groove and displacing said throttle element in the direction of the main axis by a rotation in the circumferential direction.

8. The steam turbine component according to claim 1, wherein at least one of said sealing surfaces is a thin-walled circular ring.

9. A steam turbine, comprising:

a steam turbine component including:

a main axis;

a cross-sectional area;

a separating element disposed in and filling said cross-sectional area perpendicular to said main axis;

a wall extending substantially parallel to and at a distance from said cross-sectional area;

at least one flow passage passing through said separating element, extending from said cross-sectional area along said main axis and limited by said wall, for conducting a steam flow; and a throttle element displaceable substantially along said main axis for regulating the steam flow through said flow passage, said throttle element having first and second sealing surfaces, said first sealing surface sealingly contacting said wall and said second sealing surface directly contacting said separating element in said cross-sectional area, in a position closing said flow passage, and said sealing surfaces disposed at a distance from said separating element in a position at least partially opening said flow passage.

* * * * *